United States Patent [19]

Zech

[11] Patent Number: 4,874,170

[45] Date of Patent: Oct. 17, 1989

[54] STRING CLAMP FOR RACQUET STRINGING MACHINE

[75] Inventor: Ronald G. Zech, El Cajon, Calif.

[73] Assignee: Ektelon, San Diego, Calif.

[21] Appl. No.: 249,602

[22] Filed: Sep. 26, 1988

[51] Int. Cl.[4] ..... A63B 51/14

[52] U.S. Cl. ..... 273/73 A; 24/516; 269/166; 269/169

[58] Field of Search ..... 273/73 A, 73 B; 242/149; 24/516; 269/166, 167, 169

[56] References Cited

U.S. PATENT DOCUMENTS 4,156,525 5/1979 Parnell ..... 273/73 A 4,546,977 10/1985 Bosworth, Jr. et al. ..... 273/73 A

*Primary Examiner*—William H. Grieb

*Attorney, Agent, or Firm*—Oldham & Oldham Co.

[57] ABSTRACT

A toggle action string clamp for a racquet stringing machine comprises two vise members movable along positioning glide bars attached to the stringing machine, which can be locked to the bars and to the strings of a racquet positioned in the machine. An angular link member connects a bottom vise member to a clamp-locking handle, with the top vise member being located therebetween. Locking is achieved by forcing the bottom U-shaped portion of the handle against a locking pin contained in the top vise member, thereyby urging the two vise members together. The clamp is provided with a wedge block mechanism capable of adjusting the effective distance between the bottom of the U-shaped portion and the bottom vise member, thus controlling the clearance between the vise members and, therefore, the clamping force. In the open position, due to the interaction of the clamp handle, clamp gap pins and vise member springs, the vise members open up at both ends simultaneously, facilitating positioning on the glide bars, or their complete removal.

8 Claims, 3 Drawing Sheets

STRING CLAMP FOR RACQUET STRINGING MACHINE

TECHNICAL FIELD

This invention relates to toggle-action string clamps. More particularly, this invention relates to toggle action string clamps for maintaining tension on racquet strings during the stringing of the racquets in a stringing machine. Specifically, this invention relates to string clamps adapted for support on the guide bars of a racquet stringing machine which can be moved to different locations on the bars and subsequently firmly clamped thereto, and to adjacent racquet strings, thereby maintaining the string tension generated during a tensioning procedure as a racquet is strung.

BACKGROUND OF THE INVENTION

Strung racquets are used in a wide variety of sports involving the propulsion of a game-ball by its impact with the stringed surface of the racquet. The natural resiliency of the racquet strings beneficially dampens the impact force on the users arm and wrist, improves power, and greatly enhances the directional control which can be imposed on balls struck by the racquet. Because of such attributes, strung racquets have always been very popular, and the same are employed in games such as tennis, squash, badminton, and the like. While strung racquets are admirably suited for such games, they must occasionally be restrung as a consequence of string damage resulting from misadventure, or that simply caused by ordinary wear and tear, including the natural tendency of the strings to stretch due to the repeated impacts to which they are subjected. The restringing process is ordinarily performed in a racquet stringing machine in which the strings are laced back and forth across the racquet under tension. The tension is maintained during the stringing process by means of string clamps which hold the strings tightly as they are passed back and forth within the area of the racquets frame during the restringing process, thus preventing undesirable string relaxation.

In the past, a variety of clamps have been used for such purpose, including those in which the fastening of the clamps to the stringing machine, and to the strings themselves, is usually ccomplished by means of a cam provided in the clamp mechanism. Unfortunately, however, the clamping action produced by caming is relatively unsmooth, and it is difficult to properly control the correct amount of pressure on parts of the machine to which the clamps are attached, and to the racquet strings. Among other adverse consequences caused by such lack of control is the fact that wear on the stringing machine components is increased, and undesirably erratic tensioning of the strings results.

DISCLOSURE OF THE INVENTION

In view of the preceding, therefore, it is a first aspect of the invention to provide improved string clamps for a racquet stringing machine.

A second aspect of the invention is to provide clamps for a racquet stringing machine that allow easy thumbscrew adjustment of the clamping pressure.

An additional aspect of the invention is to provide for partial opening of the glide bar clamping end of the clamp at the same time the finger, or string clamping end, is released, thus allowing totally free movement of the clamp on the glide bar during positioning.

A further aspect of this invention is the provision of racquet stringing machine clamps that allow compensation for clamp wear and for variations in their manufacturing tolerances, and provide means by which the string gripping pressure can be equalized along the fingers.

An additional aspect of this invention is to furnish racquet stringing machine clamps that open automatically when the clamp lever is disengaged, allowing easy removal from, or placement on the glide bars of racquet stringing machines to which they are attached.

A still additional aspect of this invention is to provide clamps for a racquet stringing machine which include simple, heavy-duty long-wearing mechanical components, and which provide a strong reliable clamping mechanism.

The preceding and additional aspects of the invention, as will become apparent from the following disclosure of the preferred embodiment of the invention, are provided by a toggle action string clamp for a racquet stringing machine comprising:

parallel top and bottom vise members having finger-like projections extending along the longitudinal axis of said members from one end thereof, and a simicircular groove located in the other end thereof at right angles to said axis, said grooves facing each other;

a handle member which includes a U-shaped portion and a grip lever portion;

an adjustable U-shaped wedge block;

two spacer nuts, and two angular link members, wherein said link members are positioned in slots in said vise members, the end portions of said link members being respectively connected to said bottom vise member, and to said handle member by means of connecting pins, the connecting pin connecting said handle member passing through elongated holes in the U-shaped portion thereof, and wherein the connecting pin passing through said handle member also passes through said spacer nuts, one of which is positioned on each side of said handle member, and wherein further, said wedge block is connected to said handle member by an adjustment screw and is positioned between shoulders located on said handle member, and said spacer nuts, and wherein still further, said top vise member is located between said bottom vise member and said handle member and has a locking pin extending through the slots located therein, at right angles thereto, whereby the U-shaped portion of said handle member can be forced against said locking pin, urging said vise members together when the clamp is positioned in its closed position.

The preceding and still additional aspects of the invention are provided by a racquet stringing machine furnished with toggle action string clamps according to the preceding paragraph.

BRIEF DESCRIPTION OF THE DRAWINGS

The invention will be better understood when reference is had to the following drawings of the invention, which form a part thereof, and in which.

BEST MODE FOR CARRYING OUT THE INVENTION

Figure 1:
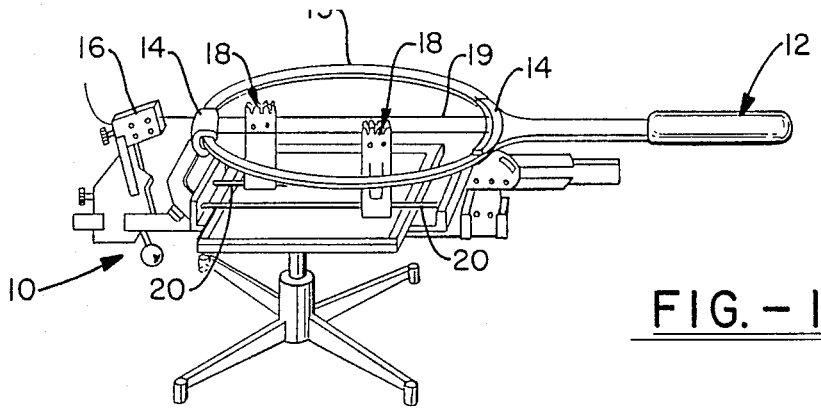
FIG. 1 is an isometric view of a tennis racquet being strung in a stringing machine employing clamps of the invention.

FIG. 1 is an isometric view of a tennis racquet, generally 12, being strung in a stringer machine, generally 10, employing toggle-action string clamps 18. As shown in the Figure, the stringing machine includes frame retainers 14 which hold the racquet head 15 securely fastened to the machine. The clamps 18 are fastened to guide bars 20 on one end, while the other end clamps onto the racquet strings 19. Tension head 16 is used to place tension on the strings during the stringing process. After passing through one end of the frame head 15, a clamp is tightened on the string adjacent to the frame, and the free end of the string is passed through the opposite end of the racquet head to the tensioning head. The string is then drawn to the proper degree of tension, and a clamp is applied to the unclamped end of the string to retain tension in the string. The racquet is then swung around 180° in the machine, and the second string is tensioned by means of the tension head. The last mentioned clamp is then released and slid to the opposite end of its glide bar, adjacent to the frame head, and clamped onto the string just tensioned. The process is repeated substantially as described until all the strings have been threaded through the frame and appropriately tensioned. The original glide bars are then removed and reinstalled at right angles to their former position, the stringing process being repeated to install additional strings at right angles to those initially installed, until the complete racquet has been strung.

Figure 2:
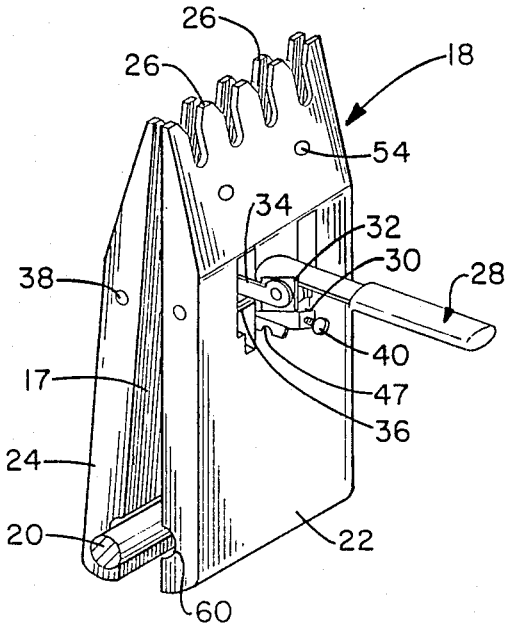
FIG. 2 is an isometric view of a toggle action string clamp of the invention in its open position.

FIG. 2 is an isometric view of a toggle-action string clamp, generally 18, of the invention in its open position. The clamp shown comprises a top vise member 22, and a bottom vise member 24, both of which are provided with string clamping fingers 26 at the top end of the vise members, and opposing semicircular grooves at the bottom end thereof, the grooves being adapted to grasp the glide bar 20 when the clamp is in its closed position. The clamp is operated by means of a handle member, generally 28, held by one end of angular link members 34, the other end of the link members being fastened to a bottom connecting pin 38. In the clamp's closed position, notch 47 of the handle member 28 is engaged and pivoted against locking pin 36. The width of the gap 17 between the vise members when the clamp is in its open position is controlled by the guide pins 54. Clamp compression pressure when the vise members are engaged is controlled by an adjustment screw 40 which forces a wedge block 30 between spacer nuts 32 and shoulders located on the handle member 28, as will be described in greater detail in connection with succeeding figures. As can be seen from FIG. 2, when the clamp lever is in its full open position, sufficient clearance is provided between the glide bar grooves 60 to allow complete removal of the clamp from the glide bar 20.

Figure 3:
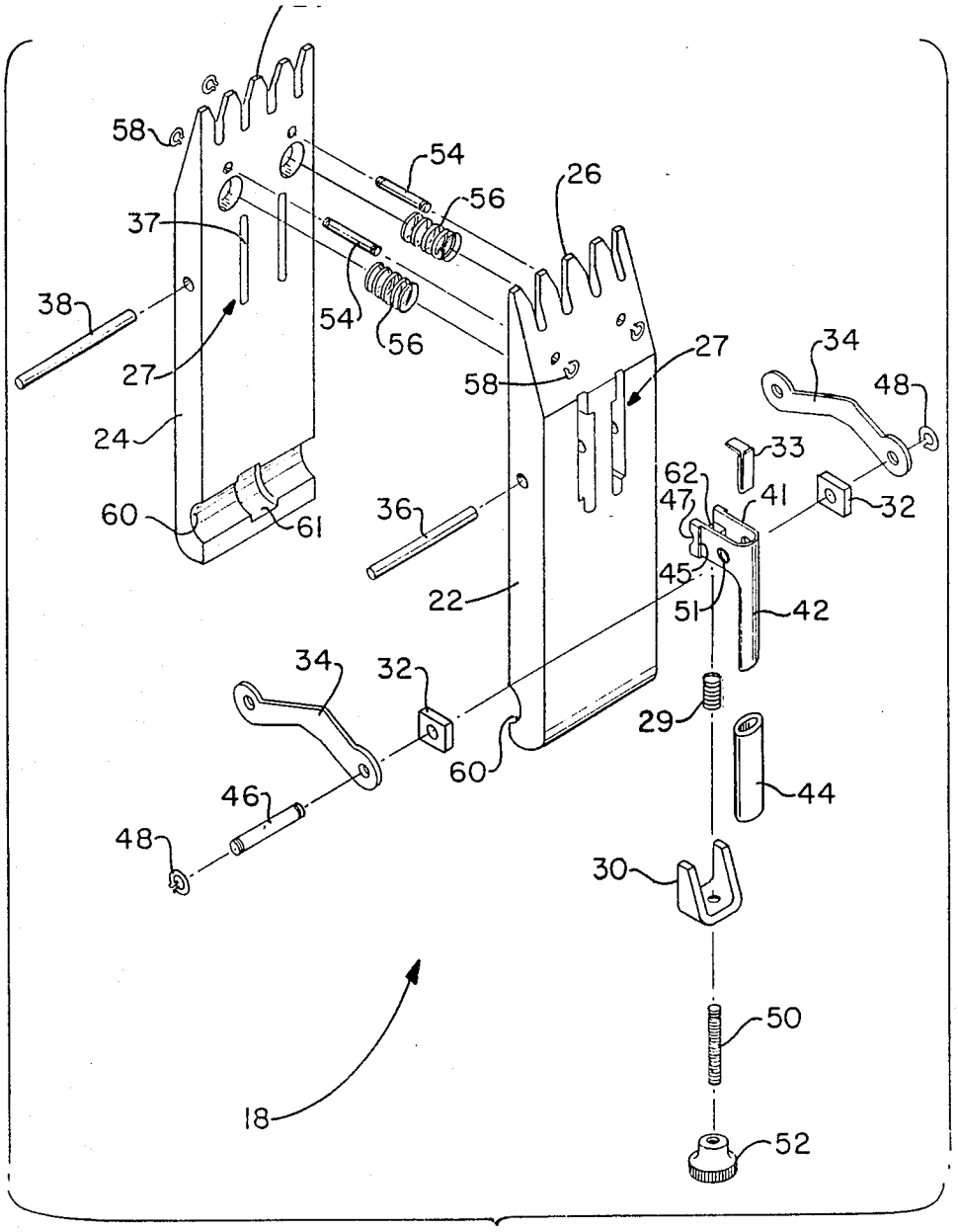
FIG. 3 is an exploded view of the components of the string clamp of the invention.

FIG. 3 shows an exploded view of the components of the string clamp 18 indicating their interrelationship in greater detail. The Figure shows the top and bottom vise members, 22 and 24, respectively, both of which are provided with fingers 26 at the top end of the members, and the glide bar grooves 60 at the lower end thereof. Frequently, it is of advantage to provide the opposing faces of the fingers with a roughened surface to improve friction on the racquet strings. While the glide bar grooves 60 may also be provided with a roughened surface, commonly, the glide bar itself is provided with such a surface, making similar treatment of the groove surface unnecessary. Vise member springs 56 are provided to assist in forcing the vise members open when the clamp is in its unclamped position, gap pins 54 furnishing guidance to the vise members as they slide along them when opening and closing, preserving alignment of the vise members and controlling the degree of opening. The handle assembly 28 comprises grip lever portion 42 and a U-shaped portion 41 integrally connected thereto. The U-shaped portion 41 has elongate holes 51 located in the sides thereof, shoulders 45, and a notch 47 in the bottom of its sides. A wedge stud nut 62 is connected between the sides of the U-shaped portion, while handle sleeve 44, typically made from a relatively soft material such as rubber or plastic, is designed to slide over the handle portion 42 to facilitate cushioning and manipulation of the handle. The handle assembly 28 is fastened to the top vise member 22 by means of a handle pin 46, secured by snap rings 48, the pin passing through the elongate holes 51. Angular link members 34, advantageously comprising a link whose end portions form a generally obtuse angle with respect to each other, connects the handle assembly 28 with bottom vise member 24. One end of the link member 34 is fastened to the bottom vise member by means of bottom connecting pin 38, while the other end is held in place by handle pin 46 which passes therethrough. The adjustment mechanism of the handle member 28 comprises spacer nuts 32, also held by handle pin 46, and wedge block 30 which rests on shoulders 45 and which is attached to the stud nut 62 by means of wedge stud 50 with a knurled nut 52 on the end thereof. A wedge spring 29 is located between the wedge block 30 and the wedge nut 62, assisting in maintaining a tight relationship between the mechanism's components. In like manner, a pin spring 33 is located between the top of the U-shaped portion and handle pin 46. Locking pin 36 passes through vise slots, generally 27, of top vise member 22, and when engaged with notch 47 of the handle serves as the support upon which the handle pivots during the opening and closing function.

It will be understood that the dimensions of the clamps, and therefore of their components, may be varied within relatively broad ranges; normally, however, the vise members will be about 5 to 6 inches long, about $1\frac{1}{2}$ to 2 inches wide, and have a thickness of about $\frac{3}{8}$ inch to $\frac{3}{4}$ inch. In such a clamp, the handle assembly 28 will ordinarily include a handle portion 42 of about 2 to 3 inches, and U-shaped sides about 1 to $1\frac{1}{2}$ inches high connected at an angle of about 90 degrees with the handle portion. Again with reference to such a clamp, the link members 34 will have a length of from about $1\frac{3}{4}$ to $2\frac{1}{4}$ inches long, and advantageously will be connected as an integral unit having an angle of from about 125° to 135° between the link ends. The wedge block 30 typically is provided with an upper surface forming an angle of about 15 degrees to about 30 degrees with respect to the lower surface thereof, and a maximum height of from about $\frac{1}{2}$ to about $\frac{3}{4}$ inch. The wedge block conveniently will be from about $\frac{3}{4}$ inch to $1\frac{1}{4}$ inches long, and from about $\frac{1}{2}$ to about 1 inch wide. In such a clamp, the spacer nuts are usually square, with sides of about ½ inch, and with about a ¾ inch hole eccentrically positioned approximately in the center thereof. Commonly the hole will be located about 2/10 of an inch from its nearest side. Referring again to the vise members, and while the diameter of the glide bar grooves 60 will depend on the diameter of the glide bar, the clamps will commonly be provided with grooves having a diameter about 9/16 inch. Where a groove separator space is provided, conveniently, it will have a width of about ½ inch. The gap pins 54, held in place by snap rings 58 will ordinarily be located about ¾ to 1 inch from the tip of the fingers 49, while the glide bar grooves will be positioned about 4½ inches to 5½ inches therefrom.

Due to the substantial forces imposed upon the vise members, it is necessary that they be fabricated from a relatively strong material, typically metal, with an aluminum alloy being preferred because of its non-corrodible nature, and light weight; however, a stamped hardened steel shell can also be used.

Figure 4:
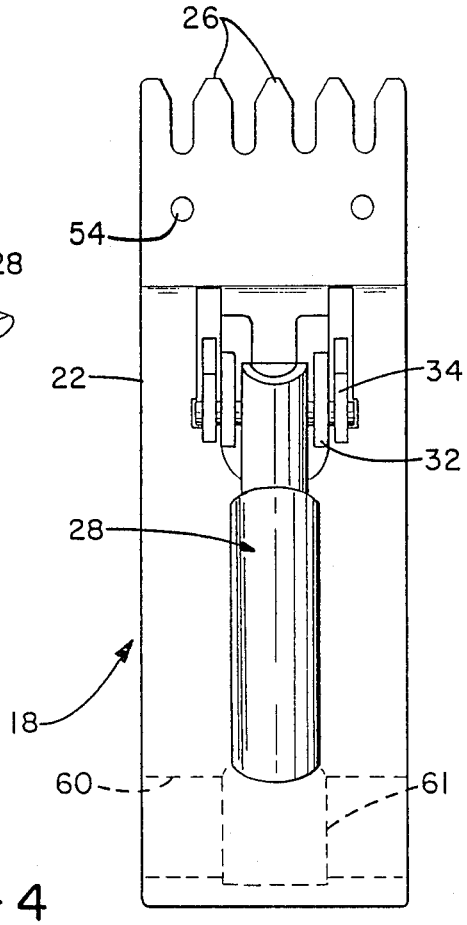
FIG. 4 is a top plan view of the string clamp of the invention.

FIG. 4 is a top plan view of the string clamp of the invention 18. The Figure illustrates the top vise member 22 with a glide bar groove 60 positioned in the lower end thereof, and containing a groove separator space 61. The handle member 28 is shown disposed between spacer nuts 32, and angular link members 34, all of said components being connected together by means of a handle pin 46. While the vise members need not include a groove separator space 61, the provision of such a space allows higher compression per unit of area to be imposed upon the glide bar groove 60, which assists in maintaining the clamp on the glide bar in a desired location.

Figure 5:
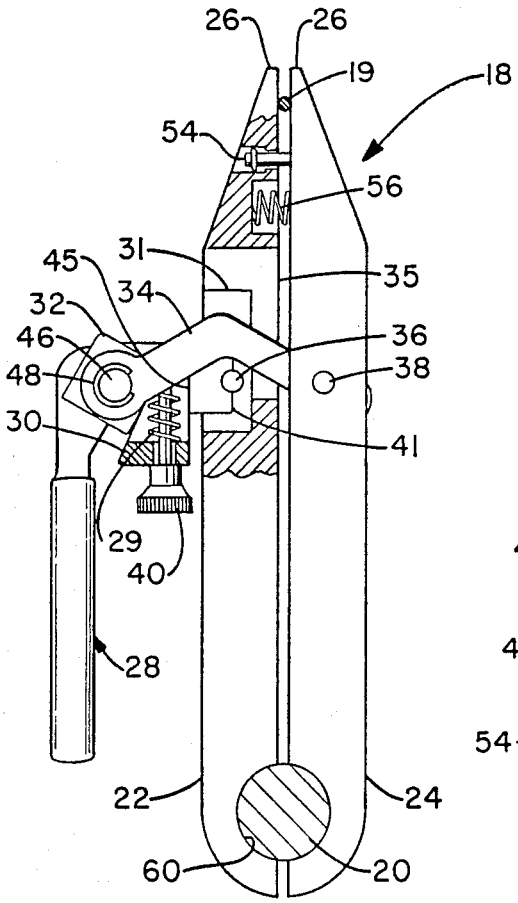
FIG. 5 is a side elevation of the string clamp of FIG. 4.

FIG. 5 is a side elevation of the string clamp 18 along line 5—5 of FIG. 4. The Figure shows a top view member 22 and a bottom vise member 24, and provides an additional view of the relationship of the vise spring 56 to the vise members, and of the gap pin 54. As shown, the clamp is fastened on a racquet string 19 at the top end of the clamp, and about a glide bar 20 positioned between glide bar grooves 60. Angular link member 34 is shown fastened to the lower vise member 24 by means of bottom connecting pin 38, and to handle assembly 28 by means of a handle pin 46. The angular link member extends through a top vise outer slot 35, the vertex of the angle of the link being substantially adjacent to locking pin 36 which extends through top vise inner slot 31. As can be seen, in its locked position, the notch located in the bottom of the sides of U-shaped portion 41 is positioned against locking pin 36. The Figure also shows wedge block 30, including its adjustment screw, generally 40, extending longitudinally therethrough, and including a wedge spring 29. The wedge block is slideably located on shoulder 45, with the inclined portion of the wedge block adjacent to spacer nut 32. As is apparent from the Figure, the purpose of the slots is to accommodate the penetration of angular link members 34 and the sides of U-shaped member 41. While the slots may be otherwise configured, commonly the top vise inner slot 31 will be about 1 inch by ⅜ from the clamp finger end of the top vise outer slot 35, which latter will usually be about 1 inch long by = inch wide. The various pins employed in the clamp, previously described, will typically be about 3/16 inch in diameter. Such pins and other moving parts of the clamp, other than the vise members, will advantageously be made of hardened steel, as will the vise members, when the latter are not fabricated from aluminum.

The wedge block shown is a simple and durable method for adjusting the distance between the vise members as required to maintain proper clearance, gripping pressures, etc. Operation of the wedge involves the turning of adjustment screw 40 which forces the inclined plane of the wedge block 50 against spacer nut 32, forcing the handle pin upwards in the elongate slots 51 against the pressure of pin spring 33, both of which latter are better seen in FIG. 3.

Due to the eccentricity in the hole in spacer nut 32, the clamp can accommodate unavoidable variations in manufacturing tolerances of the clamp components, as well as wear thereof, and provide independent pressure adjustment from one side to the other side of the clamp fingers. Such accommodation is achieved by rotating spacer nuts 32 until a desired side of a nut is presented to the inclined surface of the wedge block that furnishes the clearances required.

Locking action of the clamp is achieved by positioning notches 47 located in the bottom of the sides of the U-shaped portion 41 of the handle assembly 28 against locking pin 36. The grip lever portion 42 of the clamp is thereupon pivoted about handle pin 46, bringing the vertex of angular link member 34 against the locking pin 36, a position in which the grip lever portion 42 is substantially parallel to the vise members. The toggle action described, forces the notch securely against the locking pin, placing the clamp in its gripping position about string 19 and glide bar 20. In such position, the clamp mechanism benefits from the fact that it receives four-point support by virtue of the distribution of the clamping load at the point of contact between the angular link members 34 with the locking pin 36, and with bottom connecting pin 38.

Figure 6:
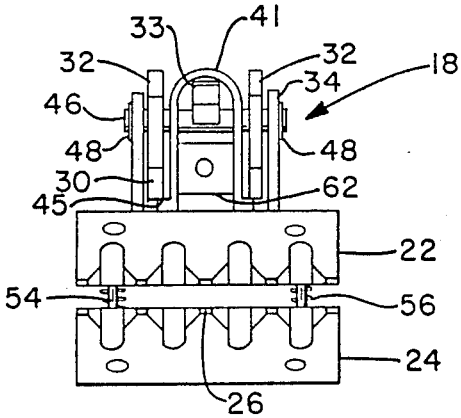
FIG. 6 is an end view of the string clamp of FIG. 4.

FIG. 6 shows another view of the string clamp 18 of FIG. 4 illustrating further details of the top and bottom vise members, 22 and 24 respectively, including the gap pins 54 and vise springs 56, which help maintain alignment of the vise members and opening gap. Shown is wedge block 30, supported on shoulders 45 of U-shaped portion 41 of the handle assembly, bearing against the side of spacer nuts 32. Also shown are pin spring 33 and handle pin 46 which connects the angular link member 34, the spacer nuts 32, and the U-shaped portion 41.

While in accordance with the patent statutes, a preferred embodiment and best mode has been presented, the scope of the invention is not limited thereto, but rather is measured by the scope of the attached claims.

What is claimed is:

1. A toggle action string clamp for a racquet stringing machine comprising:

parallel top and bottom vise members having finger-like projections extending along the longitudinal axis of said members from one end thereof, and a semicircular groove located in the other end thereof at right angles to said axis, said grooves facing each other;

a handle member which includes a U-shaped portion and a grip lever portion;

an adjustable U-shaped wedge block;

two spacer nuts, and two angular link members, wherein said link members are positioned in slots in said vise members, the end portions of said link members being respectively pivotally connected to said bottom vise member, and to said handle member by means of connecting pins, the connecting pin connecting said handle member passing through elongate holes in the U-shaped portion thereof, and wherein the connecting pin passing through said handle member also passes through said spacer nuts, one of which is positioned on each side of said handle member, and wherein further, said wedge block is connected to said handle member by an adjustment screw and is positioned between shoulders located on said handle member, and said spacer nuts, and wherein still further, said top vise member is located between said bottom vise member and said handle member and has a locking pin extending through the slots located therein, at right angles thereto, whereby the U-shaped portion of said handle member can be formed against said locking pin, urging said vise members together when the clamp is positioned in its closed position.

2. A toggle action string clamp according to claim 1 wherein said handle portion and the sides of said U-shaped portion are disposed at substantially 90 degrees relative to each other, and the bottom of said sides have a notch located therein to facilitate positioning of said sides against said locking pin.

3. A toggle action spring clamp according to claim 2 wherein the end portions of said link members form an obtuse angle relative to each other, the vertex of which is positioned adjacent said locking pin when the clamp is in its closed position.

4. A toggle action string clamp according to claim 1 wherein at least one spring is positioned between said vise members which tends to urge said members apart, and in conjunction with gap pins to separate both ends of said clamp simultaneously when the clamp is opened.

5. A toggle action string clamp according to claim 4 wherein at least one gap pin passes through both said vise members, at right angles thereto, allowing said vise members to slide therealong during the opening and closing of the clamp, thereby helping to maintain the alignment of said vise members and to control the clamp's opening distance.

6. A toggle action string clamp according to claim 1 wherein said spacer nuts are rectangular in shape, and wherein the hole therein through which said connecting pin passes is eccentric relative to the sides of said spacer nuts.

7. A toggle action string clamp according to claim 2 wherein a spring is located between the top of said U-shaped portion and the pin passing through said handle member and said spacer nuts, urging the pin and said U-shaped portion apart.

8. A racquet stringing machine furnished with toggle action string clamps according to claim 1.

* * * * *